US009843090B2

(12) United States Patent
Chou et al.

(10) Patent No.: US 9,843,090 B2
(45) Date of Patent: Dec. 12, 2017

(54) MULTI-FREQUENCY ANTENNA

(71) Applicant: UNICTRON TECHNOLOGIES CORP., Hsin-Chu (TW)

(72) Inventors: Chih-Shen Chou, Miaoli County (TW); Tsung-Shou Yeh, Hsin-Chu (TW); Shih-Chun Huang, Taoyuan County (TW); Hsiang-Cheng Yang, Taoyuan County (TW)

(73) Assignee: Unictron Technologies Corporation, Hsin-Chu (TW)

( * ) Notice: Subject to any disclaimer, the term of this patent is extended or adjusted under 35 U.S.C. 154(b) by 217 days.

(21) Appl. No.: 14/513,222

(22) Filed: Oct. 14, 2014

(65) Prior Publication Data

US 2015/0130676 A1 May 14, 2015

(30) Foreign Application Priority Data

Nov. 14, 2013 (TW) ..... 102221344 U

(51) Int. Cl.

| | |
|---|---|
| ***H01Q 9/00*** | (2006.01) |
| ***H01Q 1/24*** | (2006.01) |
| ***H01Q 21/30*** | (2006.01) |
| ***H01Q 5/371*** | (2015.01) |
| ***H01Q 5/378*** | (2015.01) |
| *H01Q 1/38* | (2006.01) |

(52) U.S. Cl.

CPC ..... *H01Q 1/243* (2013.01); *H01Q 5/371* (2015.01); *H01Q 5/378* (2015.01); *H01Q 21/30* (2013.01); *H01Q 1/38* (2013.01)

(58) Field of Classification Search

USPC ..... 343/700 MS, 702, 745, 893

See application file for complete search history.

(56) References Cited

U.S. PATENT DOCUMENTS

| | | | | |
|---|---|---|---|---|
| 6,614,398 | B2 * | 9/2003 | Kushihi | H01Q 1/243 343/700 MS |
| 7,786,938 | B2 * | 8/2010 | Sorvala | H01Q 1/243 343/700 MS |
| 2011/0095947 | A1 * | 4/2011 | Chou | H01Q 9/0421 343/700 MS |

* cited by examiner

*Primary Examiner* — Jessica Han
*Assistant Examiner* — Hai Tran
(74) *Attorney, Agent, or Firm* — Winston Hsu

(57) ABSTRACT

A multi-frequency antenna includes a ground layer, at least one antenna unit and at least one antenna network. The antenna unit has its one end electrically connected to the ground layer and its other end electrically connected to the antenna network for generating at least one first resonance frequencies. The antenna network includes at least one feeding circuit, and at least one resonance unit. Each resonance unit includes at least one resonant segment. Each resonant segment is electromagnetically coupled with the adjacent ground layer to generate at least one second resonance frequency. Thus, the multi-frequency antenna is capable of generating multiple different resonance frequencies.

14 Claims, 17 Drawing Sheets

MULTI-FREQUENCY ANTENNA

TECHNICAL FIELD

The present invention relates to antenna technology and more particularly, to a multi-frequency antenna capable of generating a plurality of different resonant frequencies.

DESCRIPTION OF THE PRIOR ART

With fast progress of wireless communication technology, wireless communication products have been widely used in our daily life. The antenna is one of the most important component parts of any of a variety of wireless communication products. An antenna normally occupies a large installation space in a wireless communication product. How to reduce antenna size so as to reduce electronic device dimension is a very important issue.

Compared to other antennas, monopole or Planar-Inverted-F Antennas (PIFA) have a low profile and can easily be integrated into active components or circuit boards for mass production. Due to the aforesaid benefits, monopole or PIFA antennas are intensively used in various wireless transmission devices, such as cell phones, smart phones, tablet computers, notebook computers, navigation devices or RFID (Radio Frequency Identification) devices. However, due to the rapid development of wireless communication industry, most mobile devices are installed with communication modules which need to transmit or receive signals in various frequency bands. Therefore, antennas with multiple resonance frequency are the essential elements for most of mobile devices. In order to design a monopole or PIFA antenna with multiple resonance frequency, large circuit board area or space is needed. In actual application, in order to meet the requirement of at least a quarter of the wavelength, the dimensions of monopole or PIFA antennas cannot be further reduced. Further, due to the complicated surrounding environment, a built-in antenna must be redesigned subject to change of the surroundings, for example, change of housing or circuit board, and will significantly increase the design-in lead time.

SUMMARY OF THE PRESENT INVENTION

It is, therefore, one object of the present invention to provide a multi-frequency antenna, which comprises a ground layer, at least one antenna unit and at least one antenna network, wherein the antenna unit has its one end electrically connected to the ground layer, and its other end electrically connected to the antenna network for generating at least one first resonance frequency. Each antenna network comprises at least one feeding circuit and at least one resonance unit, wherein each resonance unit comprises at least one resonant segment. Each resonant segment is electromagnetically coupled with the ground layer, the extension unit or the conductive unit to generate at least one respective second resonance frequency. Thus, the multi-frequency antenna of the present invention is capable of generating a plurality of different resonance frequencies, widening the application range of the antenna.

It is another object of the present invention to provide a multi-frequency antenna, which enables the antenna network to be electromagnetically coupled with the adjacent ground layer, extension unit or conductive unit subject to the wiring of the antenna network, so that the multi-frequency antenna can generate a plurality of different resonance frequencies without increasing the dimension or manufacturing cost of the antenna unit or the multi-frequency antenna. The occupied circuit board area of the multi-frequency antenna in the present invention is much smaller than circuit board area needed by monopole or PIFA antennas.

It is still another object of the present invention to provide a multi-frequency antenna, which comprises a ground layer, at least one antenna unit, and at least one antenna network, wherein the antenna unit has its one end electrically connected to the ground layer via a first adjustment device, and its other end electrically connected to the ground layer via an antenna network and a second adjustment device, and thus, the impedance and resonant frequencies of the multi-frequency antenna can be easily fine-tuned by properly choosing the first adjustment device and the second adjustment device.

To achieve these and other objectives of the present invention, the present invention provides a multi-frequency antenna, comprising: a ground layer comprising at least one clearance zone which is the cutout region of the ground layer; at least one antenna unit disposed in the clearance zone and electrically connected to the ground layer for generating at least one first resonance frequency, each the antenna unit comprising a dielectric substrate having a first surface and a second surface, and a plurality of conducting layers located on the surface of the dielectric substrate, the conducting layers comprising at least one first conducting layer and at least one second conducting layer; an antenna network disposed in the clearance zone, the antenna network comprising at least one feeding circuit electrically connected to a signal feed-in point and the ground layer, and at least one resonance unit electrically connected to the antenna unit and the feeding circuit, each the resonance unit comprising at least one resonant segment, each the resonant segment being disposed adjacent to the ground layer and electromagnetically coupled with the ground layer to generate at least one second resonance frequency.

The present invention further provides a multi-frequency antenna, comprising: a ground layer comprising at least one clearance zone; at least one antenna unit disposed in the clearance zone and electrically connected to the ground layer for generating at least one first resonance frequency, each the antenna unit comprising a dielectric substrate having a first surface and a second surface, and a plurality of conducting layers located on the surface of the dielectric substrate, the conducting layers comprising at least one first conducting layer and at least one second conducting layer; an antenna network disposed in the clearance zone, the antenna network comprising at least one feeding circuit electrically connected to a signal feed-in point and the ground layer, and at least one resonance unit electrically connected to the antenna unit and the feeding circuit, each the resonance unit comprising at least one resonant segment; and a conductive unit disposed in the clearance zone adjacent to the resonant segment and electromagnetically coupled with the resonant segment for generating at least one second resonance frequency, wherein the conductive unit is an electrically conductive segment disposed within clearance zone without contacting ground layer.

The present invention provides a multi-frequency antenna, comprising a ground layer comprising at least one clearance zone; at least one antenna unit disposed in the clearance zone and electrically connected to the ground layer for generating at least one first resonance frequency, each the antenna unit comprising a dielectric substrate having a first surface and a second surface, and a plurality of conducting layers located on the surface of the dielectric substrate and comprising at least one first conducting layer and at least one second conducting layer; first adjustment device set between the ground layer and the antenna unit and electrically connected to the ground layer and the antenna unit for fine-tuning the impedance and resonance frequency of the multi-frequency antenna; an antenna network disposed in the clearance zone, the antenna network comprising at least one feeding circuit electrically connected to a signal feed-in point and the ground layer, and at least one resonance unit electrically connected to the antenna unit and the feeding circuit, each the resonance unit comprising at least one resonant segment disposed adjacent to the ground layer and electromagnetically coupled with the ground layer for generating at least one second resonance frequency; and a second adjustment device set between the feeding circuit and the ground layer and electrically connected to the feeding circuit and the ground layer for fine-tuning the impedance and resonant frequencies of the multi-frequency antenna.

In one embodiment of the multi-frequency antenna in the present invention, the first conducting layer of the antenna unit is located on the first surface of the dielectric substrate and electrically connected to the ground layer; the second conducting layer of the antenna unit is located on the second surface of the dielectric substrate and electrically connected to the resonance unit of the antenna network, and a part of the first conducting layer overlaps a part of the second conducting layer.

In one embodiment of the multi-frequency antenna in the present invention, the first conducting layer and the second conducting layer are located on the first surface of the dielectric substrate, the first conducting layer and the second conducting layer being respectively electrically connected to the resonance unit and the ground layer, wherein the first conducting layer and the second conducting layer are spaced from each other by a gap.

In one embodiment of the multi-frequency antenna in the present invention, the resonant segment of the resonance unit comprises a first resonant segment and a second resonant segment respectively disposed adjacent to a part of the ground layer and respectively electromagnetically coupled with a part of the ground layer to generate one, respectively, the second resonance frequency.

In one embodiment of the multi-frequency antenna in the present invention, the spacing between the first resonant segment and the ground layer is in the range of 0.01 mm-3 mm; the spacing between the second resonant segment and the ground layer is in the range of 0.01 mm-3 mm.

In one embodiment of the multi-frequency antenna in the present invention, the first surface of the antenna unit has two first conducting layers separately mounted thereon, one of the said first conducting layers being electrically connected to said resonance unit, the other said first conducting layer being electrically connected to another signal feed-in point and said ground layer; at least one second conducting layer is disposed on the said second surface and is electrically connected to said ground layer, a part of each said two first conducting layers overlap respectively a part of said second conducting layer.

In one embodiment of the multi-frequency antenna in the present invention, the ground layer comprises at least one extension unit disposed adjacent to the resonant segment of the resonance unit and spaced therefrom by a gap in the range of 0.01 mm-3 mm.

In one embodiment of the multi-frequency antenna in the present invention, the first conducting layer of the antenna unit is located on the first surface of the dielectric substrate and electrically connected to the ground layer; the second conducting layer is located on the second surface of the dielectric substrate and electrically connected to the resonance unit, wherein a part of the first conducting layer overlaps a part of the second conducting layer.

In one embodiment of the multi-frequency antenna in the present invention, the first conducting layer and the second conducting layer are located on the first surface of the dielectric substrate, the first conducting layer and the second conducting layer being electrically connected respectively to the resonance unit and the ground layer, the first conducting layer being spaced from the second conducting layer by a gap.

In one embodiment of the multi-frequency antenna in the present invention, the spacing between the resonant segment and the ground layer is in the range of 0.01 mm-3 mm.

In one embodiment of the multi-frequency antenna in the present invention, the first conducting layer of the antenna unit is located on the first surface of the dielectric substrate and electrically connected to the ground layer via the first adjustment device; the second conducting layer is located on the second surface of the dielectric substrate and electrically connected to the ground layer via the resonance unit, the feeding circuit and the second adjustment device, wherein a part of the first conducting layer overlaps a part of the second conducting layer.

In one embodiment of the multi-frequency antenna in the present invention, the first conducting layer and the second conducting layer are located on the first surface of the dielectric substrate; the first conducting layer being electrically connected to the ground layer via the first adjustment device, the second conducting layer being electrically connected to the ground layer via the resonance unit, the feeding circuit and the second adjustment device, wherein the first conducting layer being spaced from the second conducting layer by a gap.

In one embodiment of the multi-frequency antenna in the present invention further comprises a conductive unit disposed in the clearance zone adjacent to and electromagnetically coupled with one of the resonant segment of the resonance unit.

In one embodiment of the multi-frequency antenna in the present invention, the spacing between the resonant segment and the conductive unit is within the range of 0.01 mm-3 mm.

In one embodiment of the multi-frequency antenna in the present invention further comprises a third adjustment device electrically connected to the conductive unit and the ground layer for fine-tuning the impedance and resonance frequency of the multi-frequency antenna.

In one embodiment of the multi-frequency antenna in the present invention, the first adjustment device, the second adjustment device and the third adjustment device comprise at least one capacitor, at least one inductor or at least one resistor.

Other advantages and features of the present invention will be fully understood by referring to the following specification in conjunction with the accompanying drawings, in which like reference signs denote like components of structures.

Figure 1:
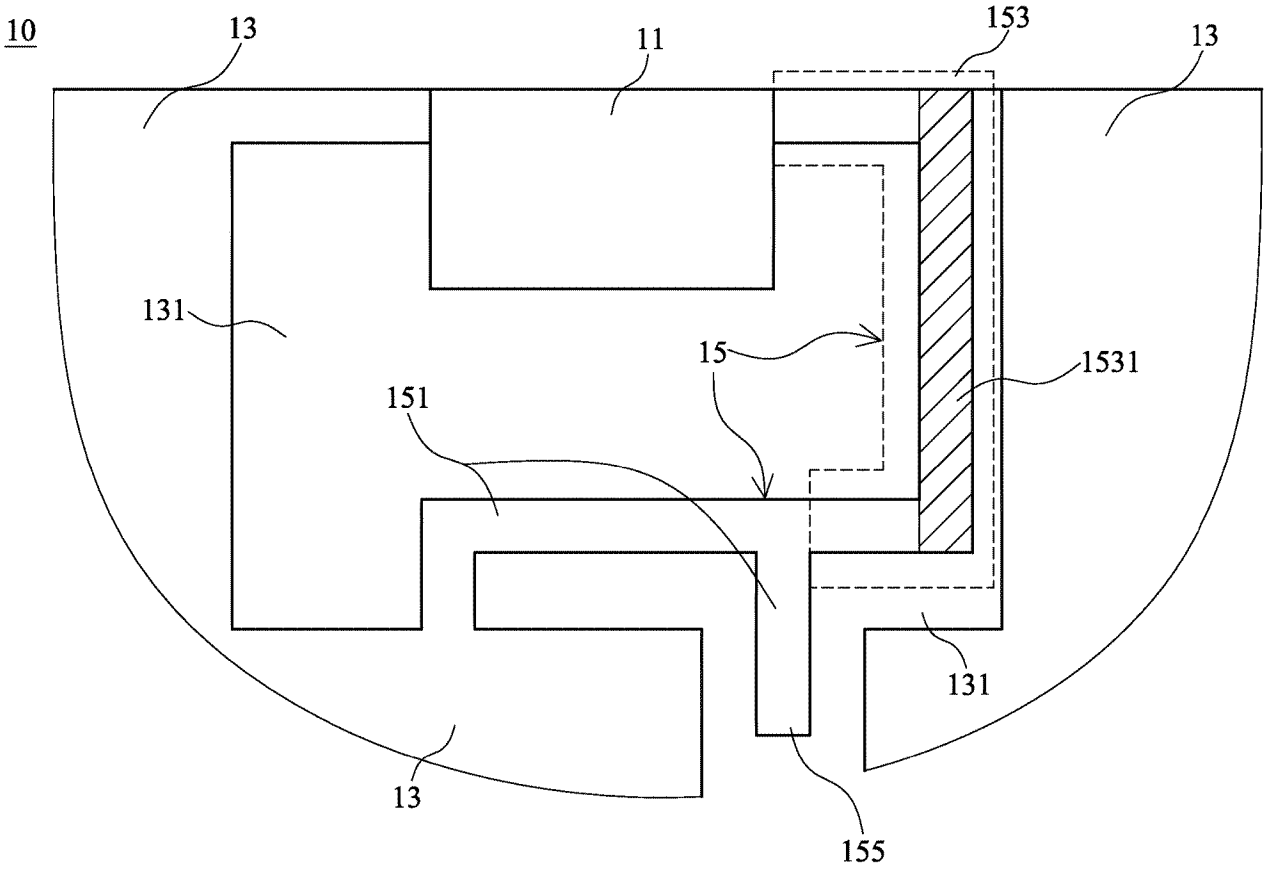
FIG. 1 is a schematic top view of a multi-frequency antenna in accordance with one embodiment of the present invention.

While the invention is susceptible to various modifications and alternative forms, specific embodiments thereof are shown by way of example in the drawings and will herein be described in detail. The drawings may not be to scale. It should be understood that the drawings and detailed description thereto are not intended to limit the invention to the particular form disclosed, but to the contrary, the intention is to cover all modifications, equivalents and alternatives falling within the spirit and scope of the present invention as defined by the appended claims.

DETAILED DESCRIPTION OF THE PREFERRED EMBODIMENTS

Please refer to FIG. 1, there is shown a schematic top view of a multi-frequency antenna in accordance with one embodiment of the present invention. As illustrated, the multi-frequency antenna 10 comprises an antenna unit 11, a ground layer 13, and an antenna network 15. The ground layer 13 comprises at least one clearance zone 131. The antenna unit 11 is disposed within the clearance zone 131 and electrically connected to the ground layer 13.

Figure 2:
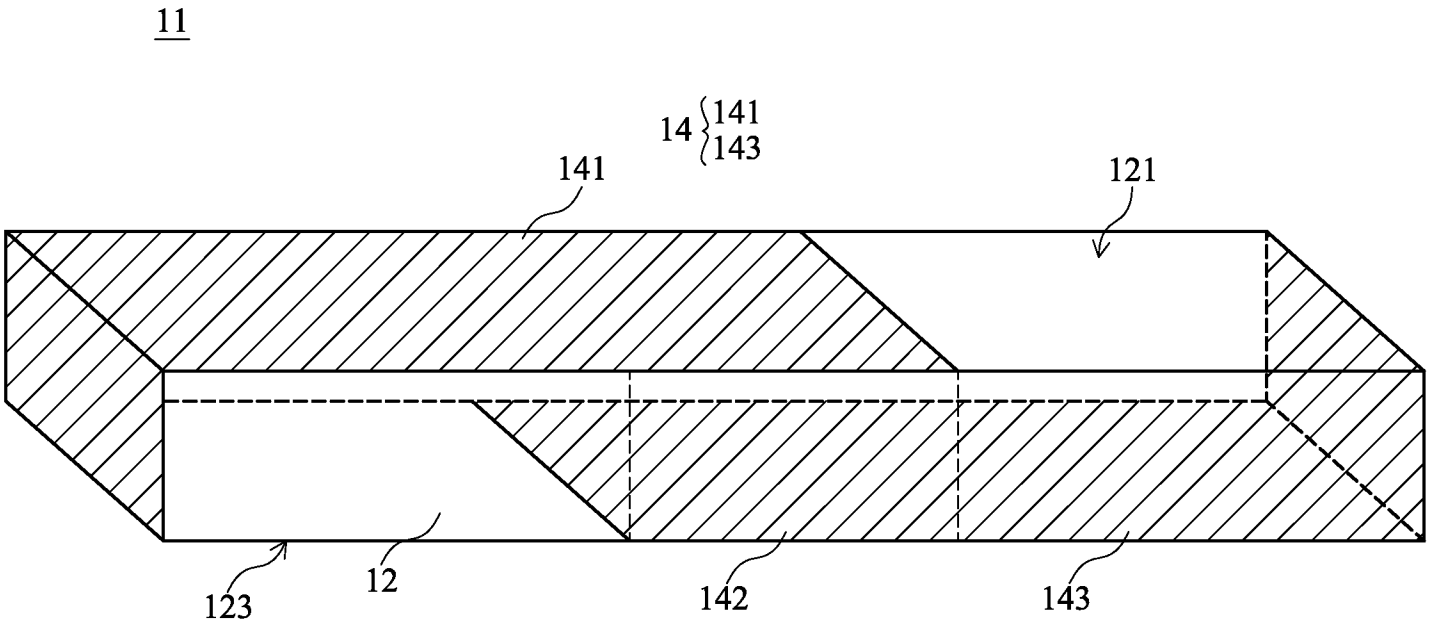
FIG. 2 is a perspective diagram of an antenna unit of a multi-frequency antenna according to one embodiment of the present invention.
Figure 3:
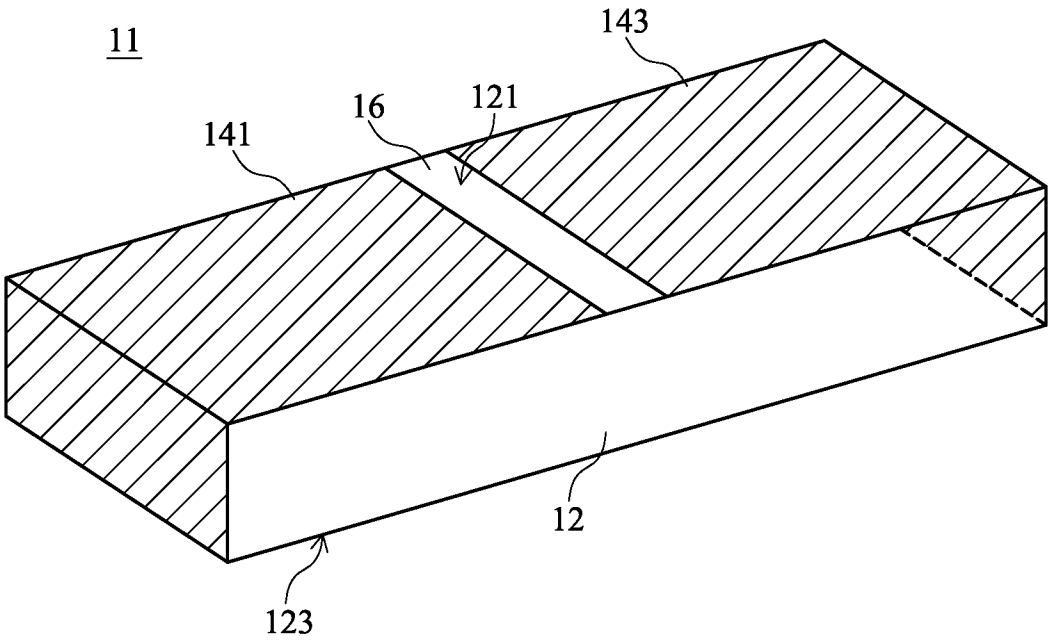
FIG. 3 is a perspective diagram of an antenna unit of a multi-frequency antenna according to another embodiment of the present invention.

Referring to FIGS. 2 and 3 and also FIG. 1, the antenna unit 11 is adapted for generating at least one first resonance frequency, and comprises a dielectric substrate 12 and a plurality of conducting layers 14 arranged on surfaces of the dielectric substrate 12.

The antenna network 15 is disposed within the clearance zone 131 and electrically connected with the antenna unit 11 and the ground layer 13, and comprises at least one feeding circuit 151 and at least one resonance unit 153. The feeding circuit 151 is electrically connected to a signal feed-in point 155 and the ground layer 13. The resonance unit 153 is electrically connected to the antenna unit 11 and the feeding circuit 151, enabling the antenna unit 11 to be electrically connected to the signal feed-in point 155 and the ground layer 13 via the resonance unit 153 and the feeding circuit 151. The resonance unit 153 comprises at least one resonant segment 1531 disposed adjacent to a part of the ground layer 13, and electromagnetically coupled with a part of the ground layer 13 to generate at least one second resonance frequency.

In this embodiment, the resonant segment 1531 is a straight line segment. Preferably, the spacing between the resonant segment 1531 and the ground layer 13 is within the range of 0.01 mm-3 mm. In actual application, the second resonance frequency is adjustable by changing the length, width, area or shape of the resonant segment 1531 and/or the spacing between the resonant segment 1531 and the ground layer 13.

In the embodiment shown in FIG. 2, the dielectric substrate 12 of the antenna unit 11 comprises a first surface 121 and a second surface 123. The first surface 121 and the second surface 123 are disposed opposite to each other, for example, opposing top and bottom surfaces. The conducting layer 14 comprises at least one first conducting layer 141 and at least one second conducting layer 143. The first conducting layer 141 is located on a part of the first surface 121 of the dielectric substrate 12, and the second conducting layer 143 is located on a part of the second surface 123 of the dielectric substrate 12. The first conducting layer 141 is electrically connected to the ground layer 13. The second conducting layer 143 is connected to the resonance unit 153, and connected to the ground layer 13 and the signal feed-in point 155 via the resonance unit 153 and the feeding circuit 151. In another embodiment of the present invention, the first conducting layer 141 can be electrically connected to the resonance unit 153, and the second conducting layer 143 can be connected to the ground layer 13.

A part of the first conducting layer 141 overlaps a part of the second conducting layer 143, forming an overlap region 142. In this overlap region 142, the first conducting layer 141, the second conducting layer 143 and the dielectric substrate 12 make up a capacitor, enabling the antenna unit 11 to generate the first resonance frequency. Further, the resonance frequency is adjustable by changing the shape and/or dimensions of the first conducting layer 141 and the second conducting layer 143, and/or the dimensions of the overlap region 142, and/or the thickness and/or dielectric constant of the dielectric substrate 12.

In an alternate form of the present invention as shown in FIG. 3, the dielectric substrate 12 of the antenna unit 11 comprises a first surface 121 and a second surface 123. The first surface 121 and the second surface 123 are disposed opposite to each other, for example, opposing top and bottom surfaces. The conducting layer 14 comprises a first conducting layer 141 and a second conducting layer 143. The first conducting layer 141 and the second conducting layer 143 are located on the first surface 121 of the dielectric substrate 12 with a designated gap 16 left between the first conducting layer 141 and the second conducting layer 143. The first conducting layer 141 is electrically connected to the resonance unit 153, and the second conducting layer 143 is electrically connected to the ground layer 13. In another embodiment, the first conducting layer 141 can be electrically connected to the ground layer 13, and the second conducting layer 143 can be electrically connected to the resonance unit 153.

The first conducting layer 141, the second conducting layer 143 and the gap 16 therebetween make up a capacitor, enabling the antenna unit 11 to generate at least one first resonance frequency. Further, the resonance frequency is adjustable by changing the shape and/or dimensions of the first conducting layer 141 and the second conducting layer 143, and/or the width and/or geometric shape of the gap 146.

In this embodiment, the antenna unit 11 has one end thereof electrically connected to the ground layer 13, for example, the first conducting layer 141 of the antenna unit 11 is electrically connected to the ground layer 13, and the other end of the antenna unit 11 is electrically connected to the ground layer 13 and the signal feed-in point 155 via the antenna network 15, wherein the signal feed-in point 155 is electrically connected to a signal feed-in line (not shown) for transmitting RF signals, for example, the second conducting layer 143 of the antenna unit 11 is electrically connected to the ground layer 13 and the signal feed-in point 155 via the antenna network 15.

Figure 4:
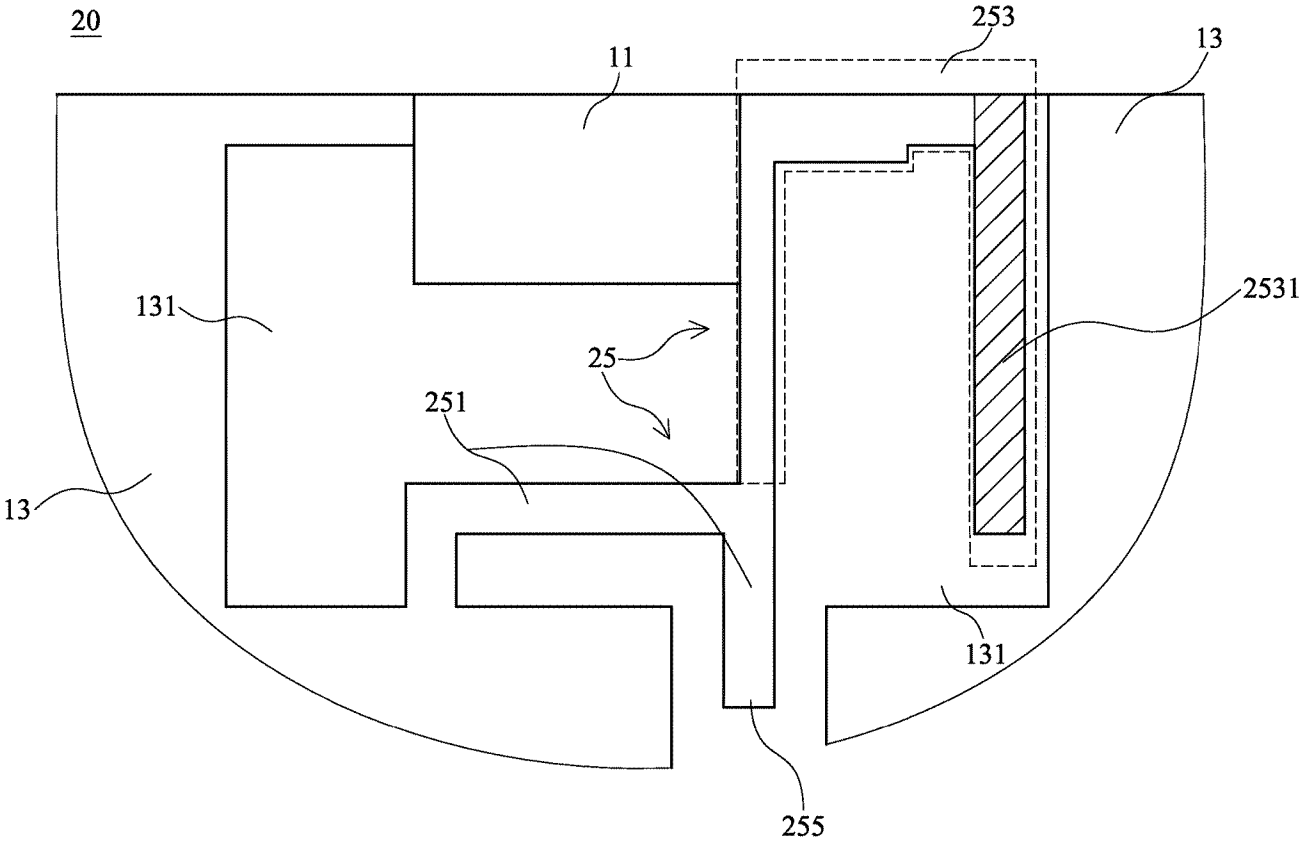
FIG. 4 is a schematic top view of a multi-frequency antenna in accordance with another embodiment of the present invention.

Referring to FIG. 4, there is shown a schematic top view of another multi-frequency antenna in accordance with the present invention. As illustrated, the multi-frequency antenna 20 comprises an antenna unit 11, a ground layer 13, and an antenna network 25, wherein the ground layer 13 comprises a clearance zone 131, and the antenna unit 11 is disposed within the clearance zone 131 and electrically connected to the ground layer 13.

The antenna unit 11 in this embodiment can be same as that shown in FIG. 2 and FIG. 3, and adapted for generating at least one first resonance frequency. The antenna network 25 within the clearance zone 131 comprises at least one feeding circuit 251 and at least one resonance unit 253. The feeding circuit 251 is electrically connected to a signal feed-in point 255 and the ground layer 13, and the resonance unit 253 is electrically connected to the antenna unit 11 and the feeding circuit 251, enabling the antenna unit 11 to be electrically connected to the ground layer 13 and the signal feed-in point 255 via the resonance unit 253 and the feeding circuit 251. The resonance unit 253 comprises at least one resonant segment 2531. The resonant segment 2531 is disposed adjacent to a part of the ground layer 13, and electromagnetically coupled with a part of the ground layer 13 for generating at least one second resonance frequency.

In this embodiment, the antenna unit 11 has one end thereof electrically connectable to the ground layer 13, for example, the first conducting layer 141 of the antenna unit 11 is electrically connected to the ground layer 13, and the other end of the antenna unit 11 is electrically connected to the ground layer 13 and the signal feed-in point 255 via the antenna network 25, wherein the signal feed-in point 255 is electrically connected to a signal feed-in line (not shown) for transmitting RF signals. For example, the second conducting layer 143 of the antenna unit 11 is electrically connected to the ground layer 13 and the signal feed-in point 255 via the antenna network 25.

In this embodiment, the resonant segment 2531 is a straight line segment. In this embodiment, the spacing between the resonant segment 2531 and the adjacent ground layer 13 is preferably within the range of 0.01 mm-3 mm. In actual applications, the second resonance frequency is adjustable by changing the length, width, area and/or shape of the resonant segment 2531 and/or the spacing between ground layer 13 and the resonant segment 2531.

Figure 5:
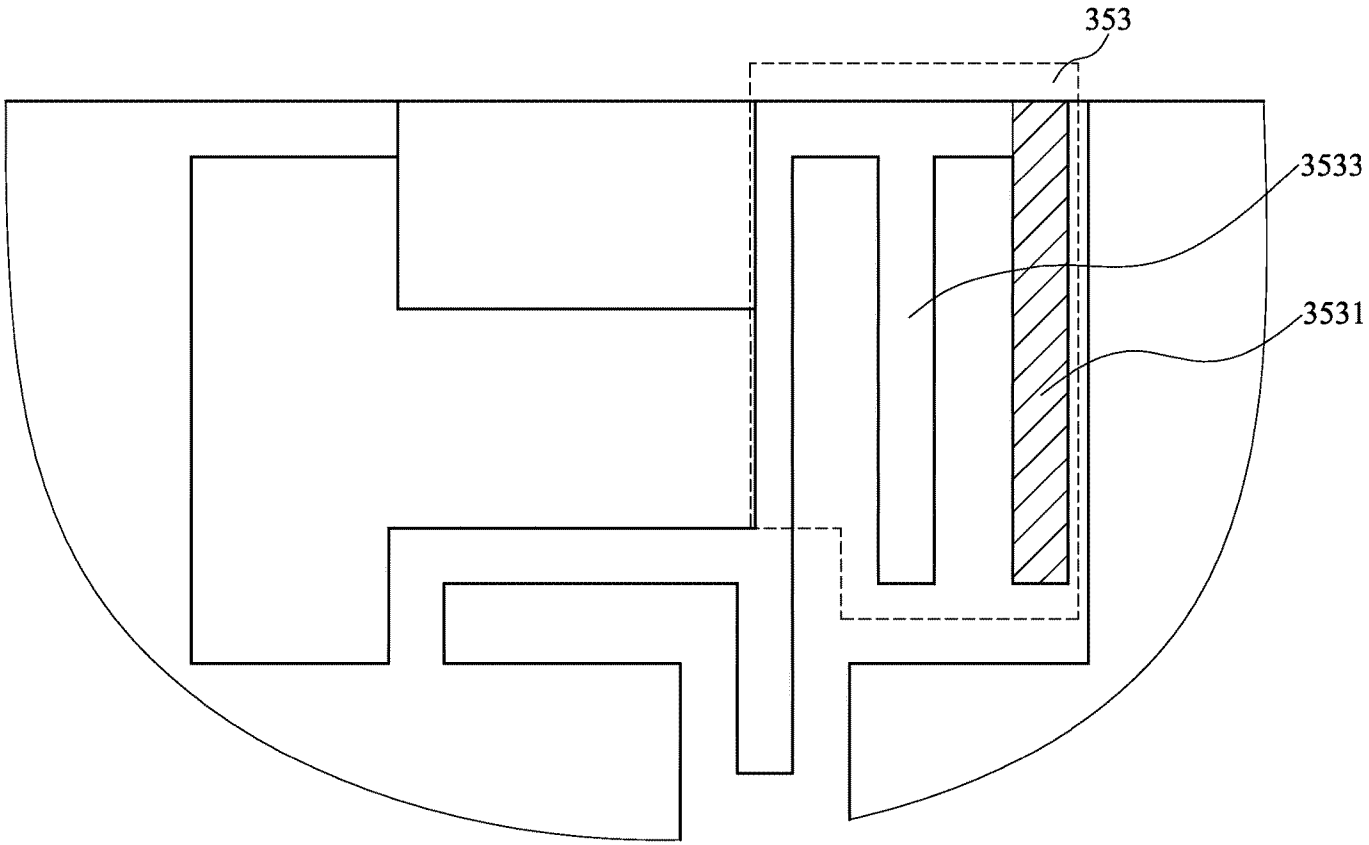
FIG. 5 is a schematic top view of a multi-frequency antenna in accordance with another embodiment of the present invention.

In still another alternate form of the present invention shown in FIG. 5, the resonance unit 353 comprises a resonant segment 3531 and at least one protruding units 3533, wherein the resonance unit 353 is shaped substantially like an inverted E, and the resonant segment 3531 is a straight line segment.

Figure 6:
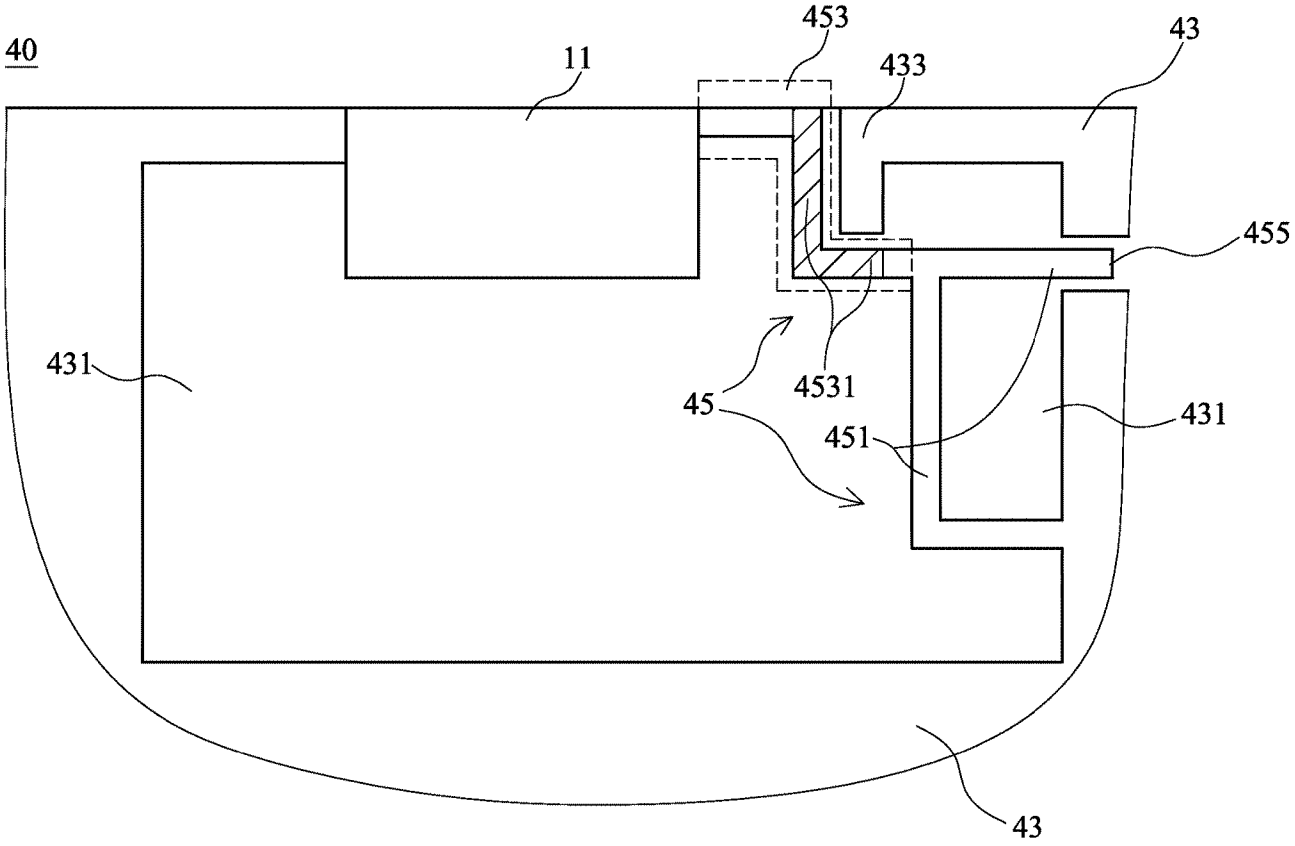
FIG. 6 is a schematic top view of a multi-frequency antenna in accordance with another embodiment of the present invention.

Referring to FIG. 6, there is shown a schematic top view of another multi-frequency antenna in accordance with the present invention. As illustrated, the multi-frequency antenna 40 mainly comprises an antenna unit 11, a ground layer 43 and an antenna network 45, wherein the ground layer 43 comprises a clearance zone 431 and an extension unit 433, and the antenna unit 11 is disposed within the clearance zone 431 and electrically connected to the ground layer 43.

The antenna unit 11 in this embodiment can be same as that shown in FIG. 2 and FIG. 3, and adapted to generate at least one first resonance frequency. The antenna network 45 within the clearance zone 431 comprises at least one feeding circuit 451 and at least one resonance unit 453. The feeding circuit 451 is electrically connected to a signal feed-in point 455 and the ground layer 43. The resonance unit 453 is electrically connected to the antenna unit 11 and the feeding circuit 451, enabling the antenna unit 11 to be electrically connected to the signal feed-in point 455 and the ground layer 43 via the resonance unit 453 and the feeding circuit 451. The resonance unit 453 comprises at least one resonant segment 4531. The resonant segment 4531 is disposed adjacent to the extension unit 433 of the ground layer 43, and electrically coupled with the extension unit 433 for generating at least one second resonance frequency.

In this embodiment, one end of the antenna unit 11 is electrically connected to the ground layer 43, for example, the first conducting layer 141 of the antenna unit 11 is electrically connected to the ground layer 43, and the other end of the antenna unit 11 is electrically connected to the ground layer 43 and the signal feed-in point 455 via the antenna network 45, wherein the signal feed-in point 455 is electrically connected to a signal feed-in line (not shown) for transmitting RF signals, for example, the second conducting layer 143 of the antenna unit 11 is electrically connected to the ground layer 13 and the signal feed-in point 455 via the antenna network 45.

In this embodiment, the extension unit 433 is electrically connected to the ground layer 43, therefore the ground layer 43 extends to the inside of the clearance zone 431. The resonance unit 453 has a zigzag or meandering configuration. The resonant segment 4531 has an L-shaped configuration. In this embodiment, the spacing between the resonant segment 4531 and the adjacent extension unit 433 is preferably within the range of 0.01 mm-3 mm. In actual applications, the second resonance frequency is adjustable by changing the length, width, area and/or shape of the resonant segment 4531 and/or the spacing between the extension unit 433 and the resonant segment 4531.

Figure 7:
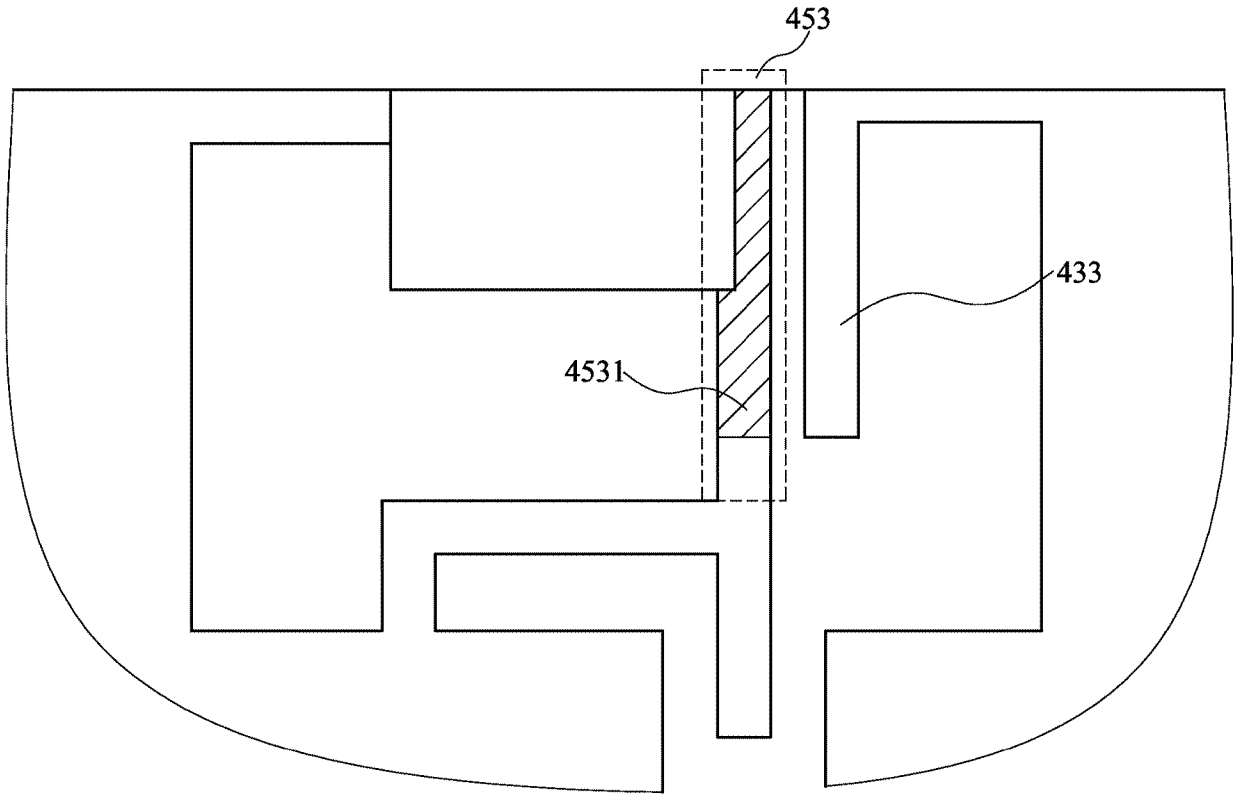
FIG. 7 is a schematic top view of a multi-frequency antenna in accordance with another embodiment of the present invention.

In still another alternate form of the present invention as shown in FIG. 7, the extension unit 433 has a substantially L-shaped configuration, and the resonant segment 4531 of the resonance unit 453 is a straight resonance line segment.

Figure 8:
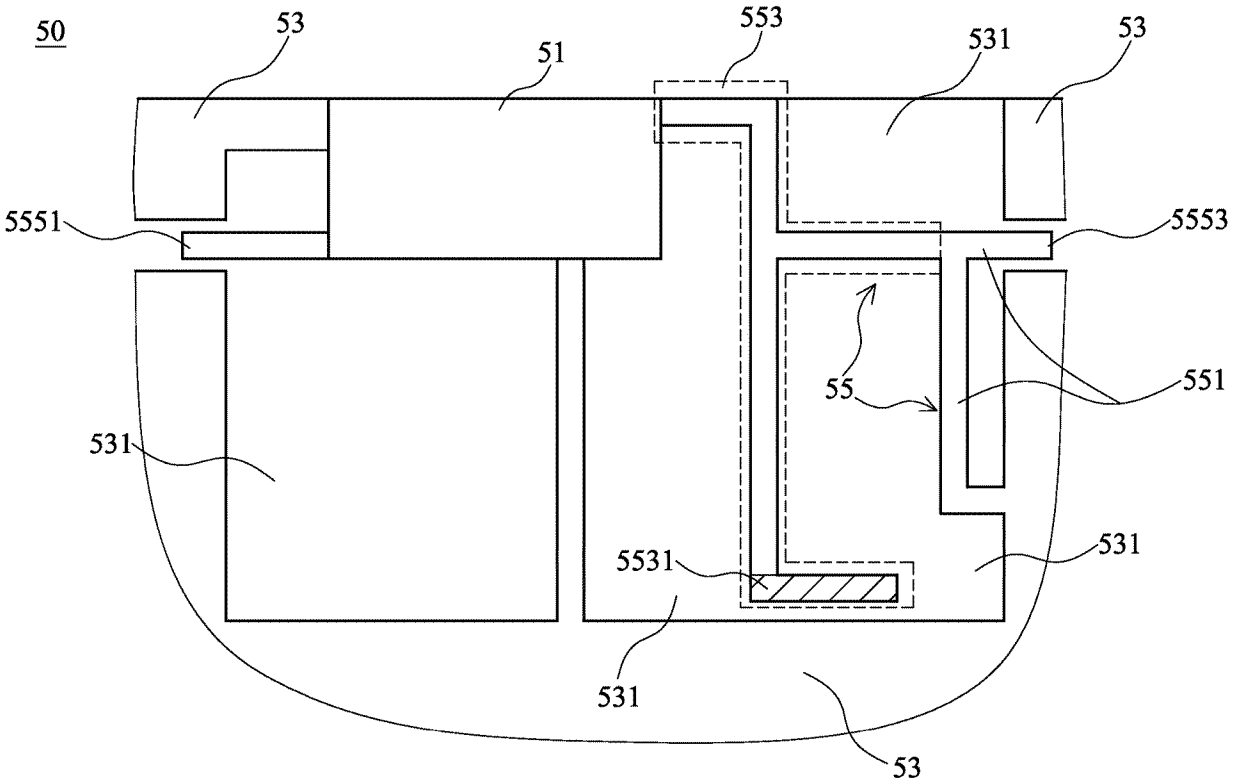
FIG. 8 is a schematic top view of a multi-frequency antenna in accordance with another embodiment of the present invention.

Referring to FIG. 8, there is shown a schematic top view of another embodiment of the multi-frequency antenna in accordance with the present invention. As illustrated, the multi-frequency antenna 50 comprises an antenna unit 51, a ground layer 53 and an antenna network 55, wherein the ground layer 53 comprises a clearance zone 531, and the antenna unit 51 is disposed within the clearance zone 531.

Figure 9:
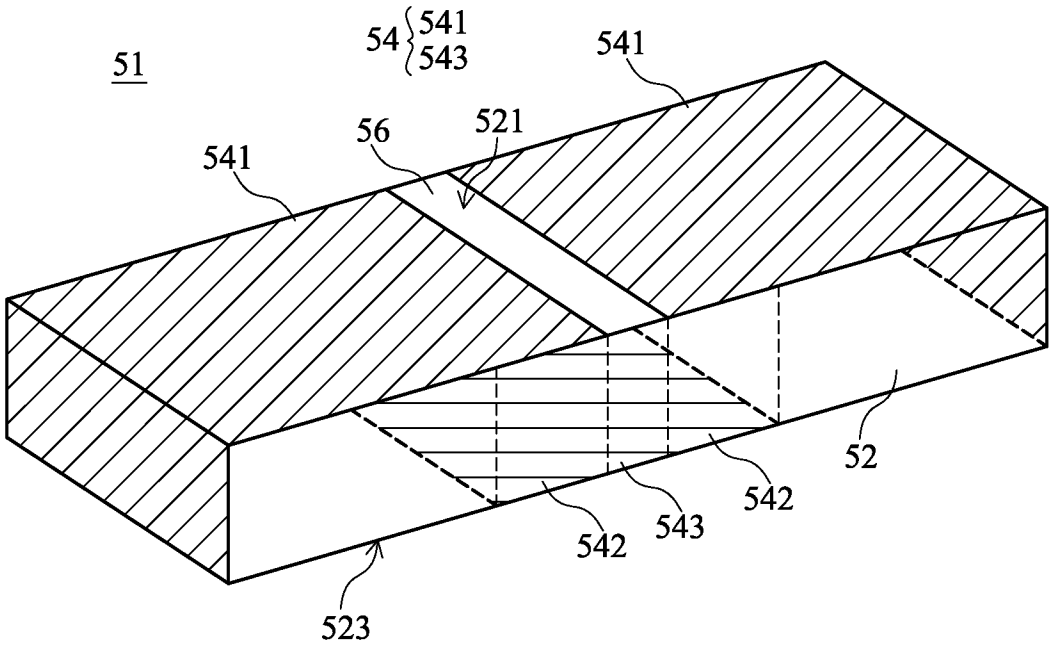
FIG. 9 is a perspective diagram of an antenna unit of a multi-frequency antenna according to another embodiment of the present invention.

Referring also to FIG. 9, the antenna unit 51 is adapted for generating two different first resonance frequencies, and comprises a dielectric substrate 52 and a plurality of conducting layers 54, wherein the conducting layers 54 are disposed on the surface of the dielectric substrate 52.

The dielectric substrate 52 of the antenna unit 51 comprises a first surface 521 and a second surface 523, wherein the first surface 521 and the second surface 523 are disposed opposite to each other, for example, opposing top and bottom surfaces. The conducting layer 54 comprises two first conducting layers 541 and one second conducting layer 543, wherein the two first conducting layers 541 are located on a part of the first surface 521 of the dielectric substrate 52 with a gap 56 left therebetween, and the second conducting layer 543 is located on a part of the second surface 523 of the dielectric substrate 52.

A part of the two first conducting layers 541 respectively overlap a part of the second conducting layer 543, forming two overlapping regions 542. The two first conducting layers 541, the second conducting layer 543 and the dielectric substrate 52 in the overlapping regions 542 form two capacitors respectively, enabling the antenna unit 51 to generate two same or different first resonance frequencies. Further, the two first resonance frequencies are adjustable by changing the shape and/or dimensions of the first conducting layers 541 and the second conducting layer 543, the dimensions of the two overlapping regions 542 and/or the thickness and/or dielectric constant of the dielectric substrate 52.

The two first conducting layers 541 are electrically connected to the ground layer 53 and respectively one signal feed-in point 5551 or 5553. For example, one first conducting layer 541 is directly electrically connected to the first signal feed-in point 5551 and the ground layer 53, and the other first conducting layer 541 is electrically connected to the second signal feed-in point 5553 and the ground layer 53 via the antenna network 55 (for example, the resonance unit 553 and the feeding circuit 551). The second conducting layer 543 is electrically connected to the ground layer 53.

The antenna network 55 is disposed within the clearance zone 531, and comprises at least one feeding circuit 551 and at least one resonance unit 553. The feeding circuit 551 is electrically connected to the second signal feed-in point 5553 and the ground layer 53. The resonance unit 553 is electrically connected to the antenna unit 51 and the feeding circuit 551, enabling the antenna unit 51 to be electrically connected to the second signal feed-in point 5553 and the ground layer 53 via the resonance unit 553 and the feeding circuit 551. The resonance unit 553 comprises at least one resonant segment 5531. The resonant segment 5531 is disposed adjacent to a part of the ground layer 53, and electromagnetically coupled with a part of the ground layer 53 for generating at least one second resonance frequency.

In this embodiment, the spacing between the resonant segment 5531 of the resonance unit 553 and the ground layer 53 is preferably within the range of 0.01 mm-3 mm. In actual application, the second resonance frequency is adjustable by changing the length, width, area and/or shape of the resonant segment 5531 and/or the spacing between the ground layer 53 and the resonant segment 5531.

Figure 10:
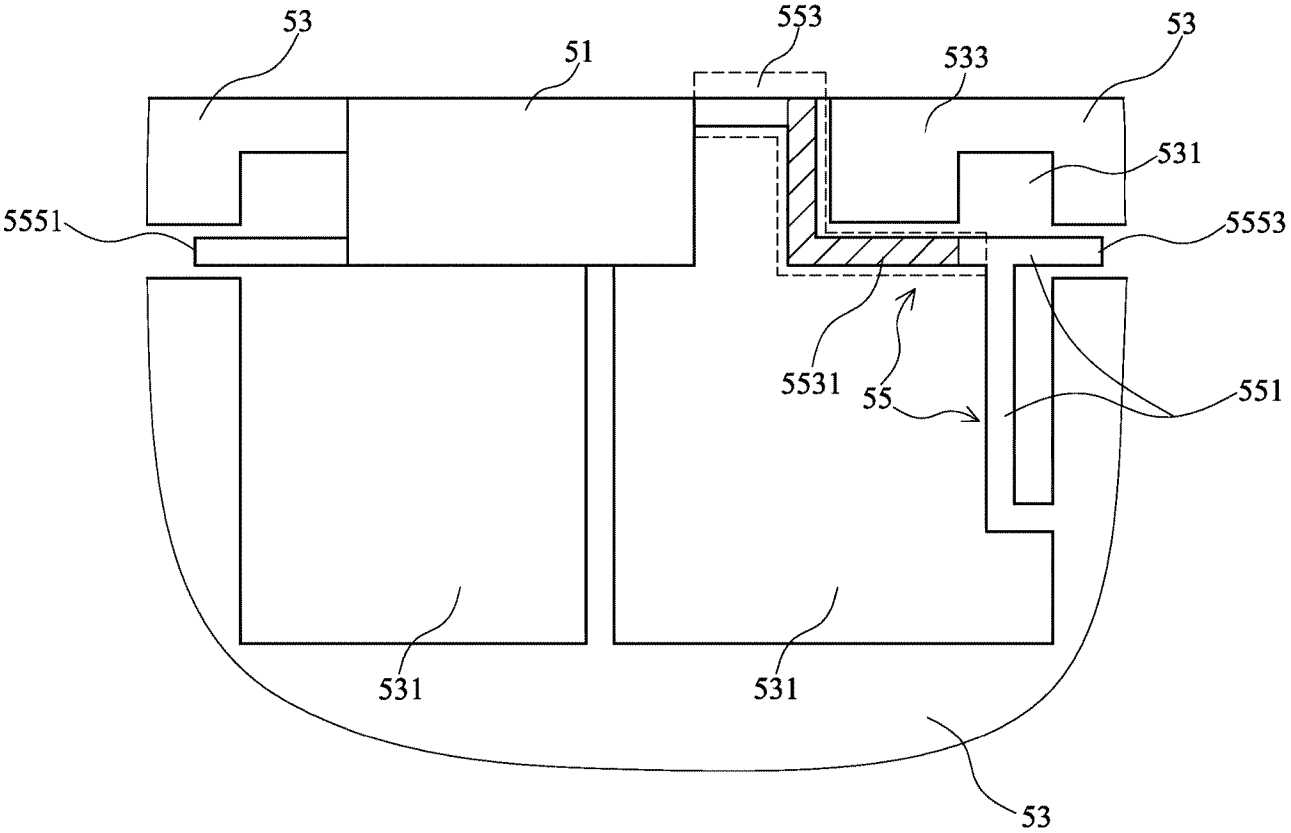
FIG. 10 is a schematic top view of a multi-frequency antenna in accordance with another embodiment of the present invention.

In still another alternate form of the present invention shown in FIG. 10, the ground layer 53 comprises an extension unit 533. The extension unit 533 is electrically connected to the ground layer 53 and extends to the inside of the clearance zone 531. The resonance unit 553 has a zigzag or meandering configuration. The resonant segment 5531 has an L-shaped configuration. In this embodiment, the spacing between the resonant segment 5531 and the adjacent extension unit 533 is preferably within the range of 0.01 mm-3 mm. In actual applications, the second resonance frequency is adjustable by changing the length, width, area and/or shape of the resonant segment 5531 and/or the spacing between the extension unit 533 and the resonant segment 5531.

Figure 11:
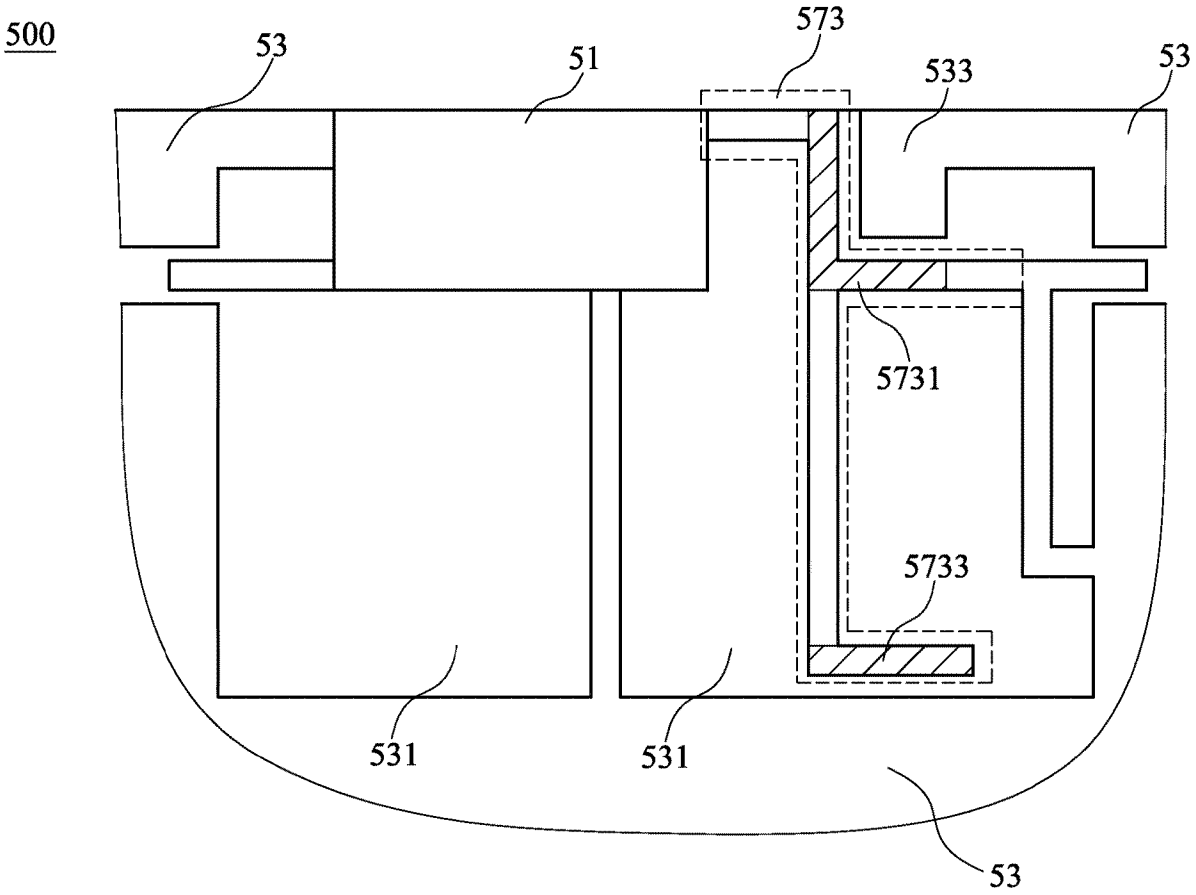
FIG. 11 is a schematic top view of a multi-frequency antenna in accordance with another embodiment of the present invention.

In still another alternate form of the present invention as shown in FIG. 11, the resonance unit 573 comprises a first resonant segment 5731 and a second resonant segment 5733, and the ground layer 53 comprises an extension unit 533. The first resonant segment 5731 is disposed adjacent to the extension unit 533 of the ground layer 53, and electromagnetically coupled with the extension unit 533. The second resonant segment 5733 is disposed adjacent to a part of the ground layer 53, and electromagnetically coupled with a part of the ground layer 53 for generating two same or different second resonance frequencies. For example, the first resonant segment 5731 and the extension unit 533 can generate a second resonance frequency, and the second resonant segment 5733 is electromagnetically coupled with a part of the ground layer 53 to generate another second resonance frequency. In other words, the multi-frequency antenna 500 in FIG. 11 is capable of generating four different resonance frequencies, wherein the antenna unit 51 is adapted for generating two different first resonance frequencies, and the resonance unit 573 is adapted for generating two different second resonance frequencies.

In this embodiment, the spacing between the first resonant segment 5731 and a part of the ground layer 53, for example, the extension unit 533 of the ground layer 53 is preferably within the range of 0.01 mm-3 mm. The spacing between the second resonant segment 5733 and the adjacent ground layer 53 is preferably within the range of 0.01 mm-3 mm. In actual application, changing the length, width, area and/or shape of the first resonant segment 5731 and the spacing between the first resonant segment 5731 and the extension unit 533 of the ground layer 53 can adjust the respective second resonance frequency. Changing the length, width, area and/or shape of the second resonant segment 5733 and the spacing between the second resonant segment 5733 and the ground layer 53 can adjust the respective second resonance frequency.

Figure 12:
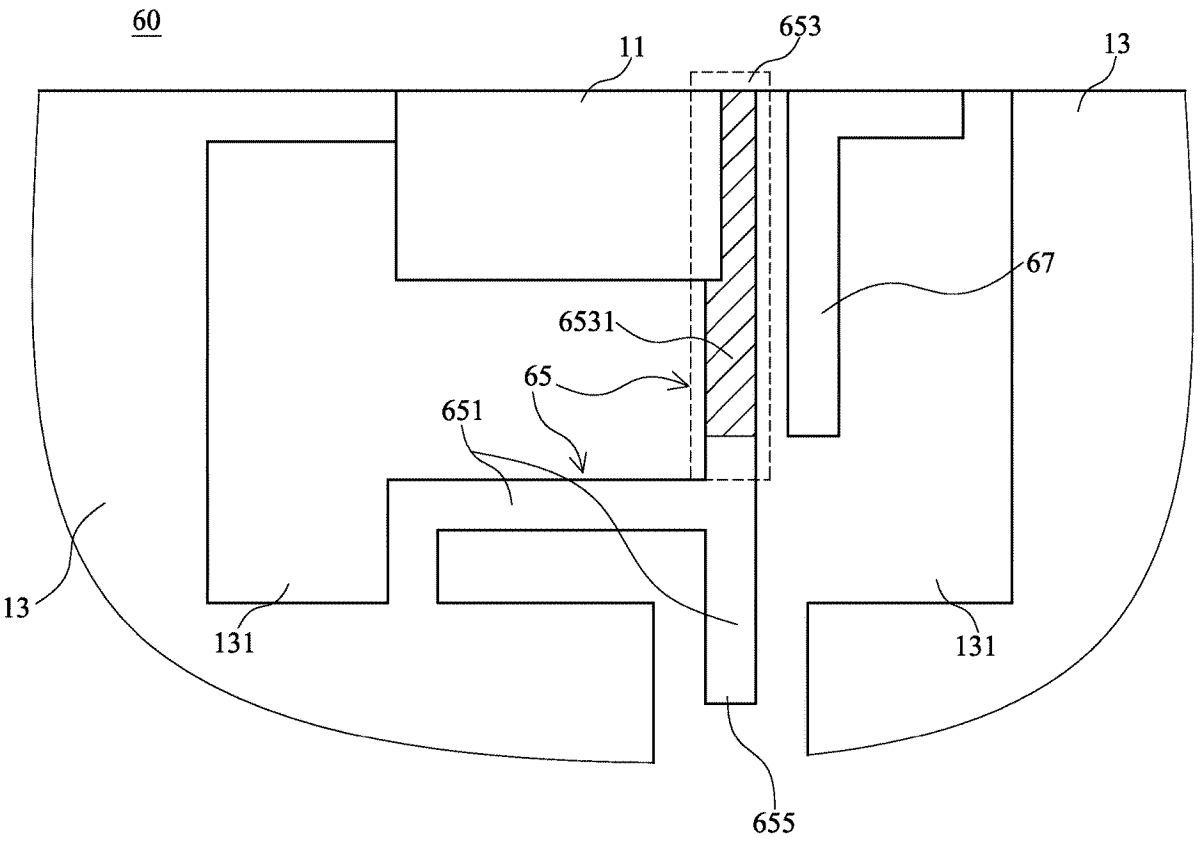
FIG. 12 is a schematic top view of a multi-frequency antenna in accordance with another embodiment of the present invention.

Referring to FIG. 12, there is shown a schematic top view of another embodiment of the multi-frequency antenna in accordance with the present invention. As illustrated, the multi-frequency antenna 60 mainly comprises an antenna unit 11, a ground layer 13, an antenna network 65 and a conductive unit 67, wherein the ground layer 13 comprises a clearance zone 131. The antenna unit 11 is disposed in the clearance zone 131, the conductive unit 67 is a conducting layer disposed in the clearance zone 131, the antenna unit 11 is electrically connected to the ground layer 13, and the conductive unit 67 is isolated from the ground layer 13.

Referring also to FIG. 2 and FIG. 3 for this embodiment, the antenna unit 11 is adapted for generating at least one first resonance frequency, and comprises a dielectric substrate 12 and a plurality of conducting layers 14, wherein the conducting layer 14 is located on the surface of the dielectric substrate 12.

The antenna network 65 is disclosed in the clearance zone 131, and comprises at least one feeding circuit 651 and at least one resonance unit 653. The feeding circuit 651 is electrically connected to a signal feed-in point 655 and the ground layer 13. The resonance unit 653 is electrically connected to the antenna unit 11 and the feeding circuit 651 so that the antenna unit 11 is electrically connected to the signal feed-in point 655 and the ground layer 13 via the resonance unit 653 and the feeding circuit 651. The resonance unit 653 comprises at least one resonant segment 6531 disposed adjacent to the conductive unit 67 and electromagnetically coupled with the conductive unit 67 to generate at least one second resonance frequency.

Figure 13:
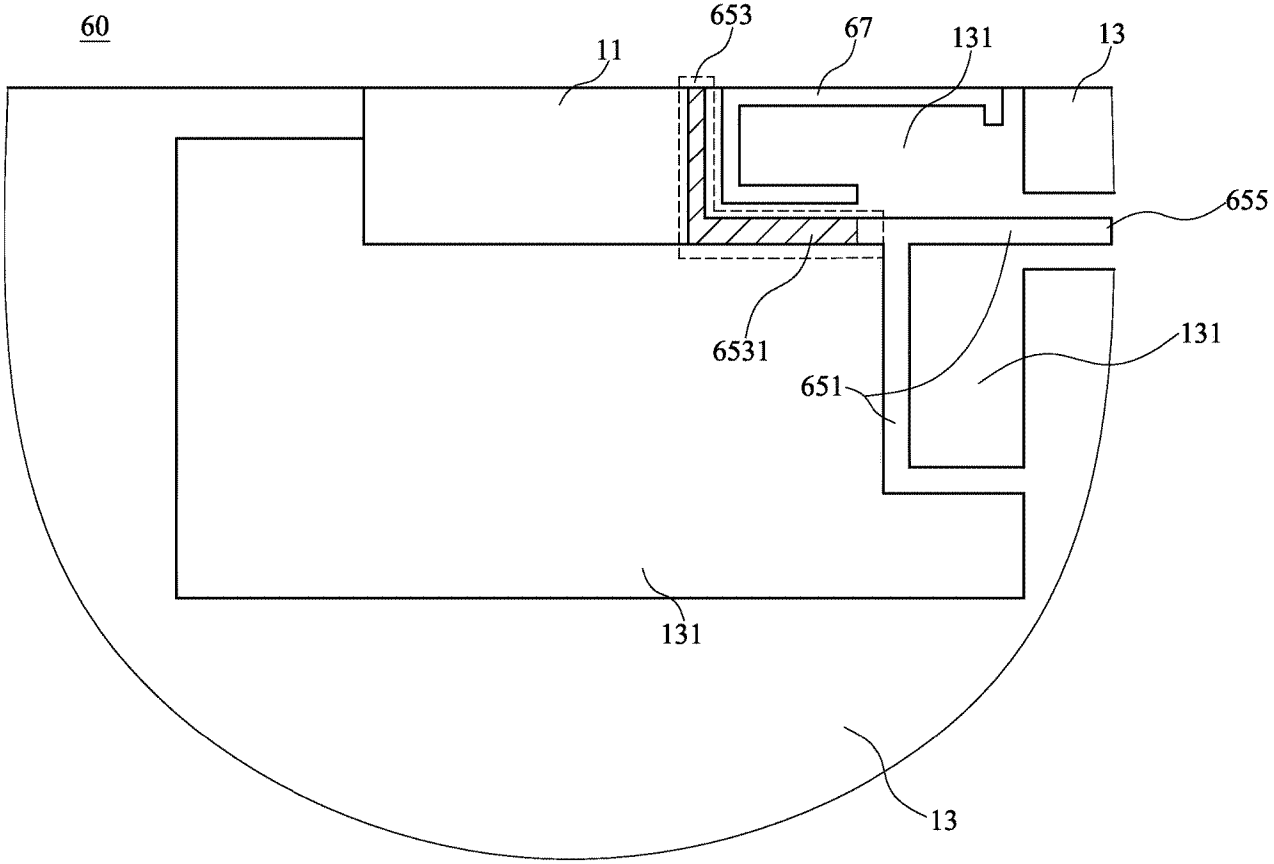
FIG. 13 is a schematic top view of a multi-frequency antenna in accordance with another embodiment of the present invention.

In this embodiment, the resonant segment 6531 is a straight line segment, and the conductive unit 67 has a substantially L-shaped configuration. Further, the spacing between the resonant segment 6531 and the adjacent conductive unit 67 is preferably within the range of 0.01 mm-3 mm. In actual application, the second resonance frequency is adjustable by changing the length, width, area and/or shape of the resonant segment 6531 and/or the spacing between the conductive unit 67 and the resonant segment 6531. Alternatively, as shown in FIG. 13, the resonant segment 6531 can be made having an L-shaped configuration, and the conductive unit 67 can be shaped like C-shaped configuration.

Figure 14:
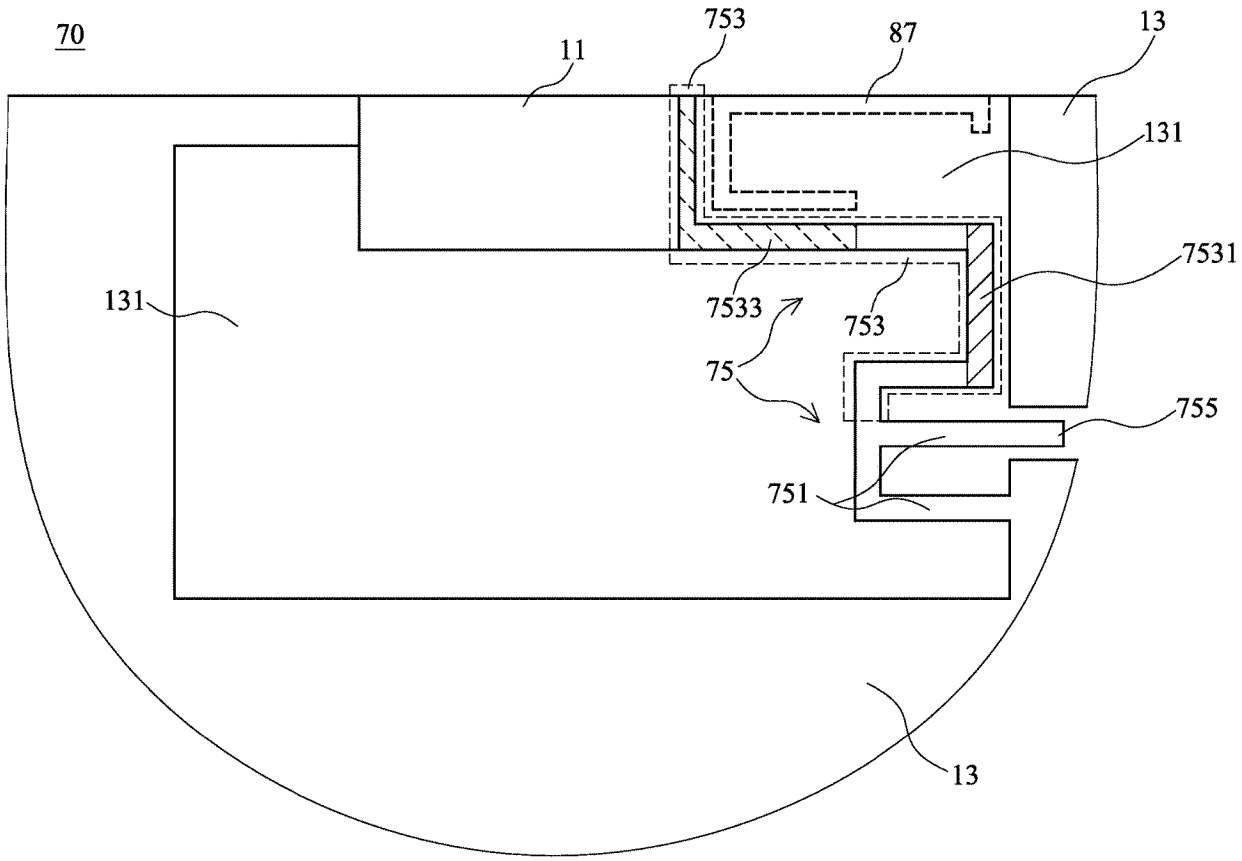
FIG. 14 is a schematic top view of a multi-frequency antenna in accordance with another embodiment of the present invention.

Referring to FIG. 14, there is shown a schematic top view of another embodiment of the multi-frequency antenna in accordance with the present invention. As illustrated, the multi-frequency antenna 70 mainly comprises an antenna unit 11, a ground layer 13 and an antenna network 75, wherein the ground layer 13 comprises a clearance zone 131, and the antenna unit 11 is disposed in the clearance zone 131 and electrically connected to the ground layer 13.

In this embodiment, referring also to FIG. 2 and FIG. 3, the antenna 11 is adapted for generating at least one first resonance frequency, and comprises a dielectric substrate 12 and a plurality of conducting layers 14, wherein the conducting layers 14 are located on the surface of the dielectric substrate 12.

The antenna network 75 is disposed in the clearance zone 131 and comprises at least one feeding circuit 751 and at least one resonance unit 753. The feeding circuit 751 is electrically connected to a signal feed-in point 755 and the ground layer 13, and the resonance unit 753 is electrically connected to the antenna unit 11 and the feeding circuit 751 so that the antenna unit 11 is electrically connected to the signal feed-in point 755 and ground layer 13 via the resonance unit 753 and the feeding circuit 751. The resonance unit 753 comprises at least one resonant segment 7531 disposed adjacent to a part of the ground layer 13 and electromagnetically coupled with the ground layer 13 to generate at least one second resonance frequency. In this embodiment the spacing between the resonant segment 7531 and the adjacent ground layer 13 is preferably within the range of 0.01 mm-3 mm. In actual application, the second resonance frequency is adjustable by changing the length, width and/or area of the resonant segment 7531, and/or the spacing between the resonant segment 7531 and the ground layer 13.

Furthermore, a conductive unit 87 can be provided in the clearance zone 131. The conductive unit 87 is spaced from the ground layer 13 by a spacing. Further, a part of the conductive unit 87 is disposed adjacent to and electromagnetically coupled with another resonant segment 7533. The electromagnetic coupling effect between the conductive unit 87 and the resonant segment 7533 interacts with the electromagnetic coupling effect between the resonant segment 7531 and the ground layer 13 to generate another second resonance frequency. The spacing between the resonant segment 7533 and the conductive unit 87 is preferably within the range of 0.01 mm-3 mm.

Figure 15:
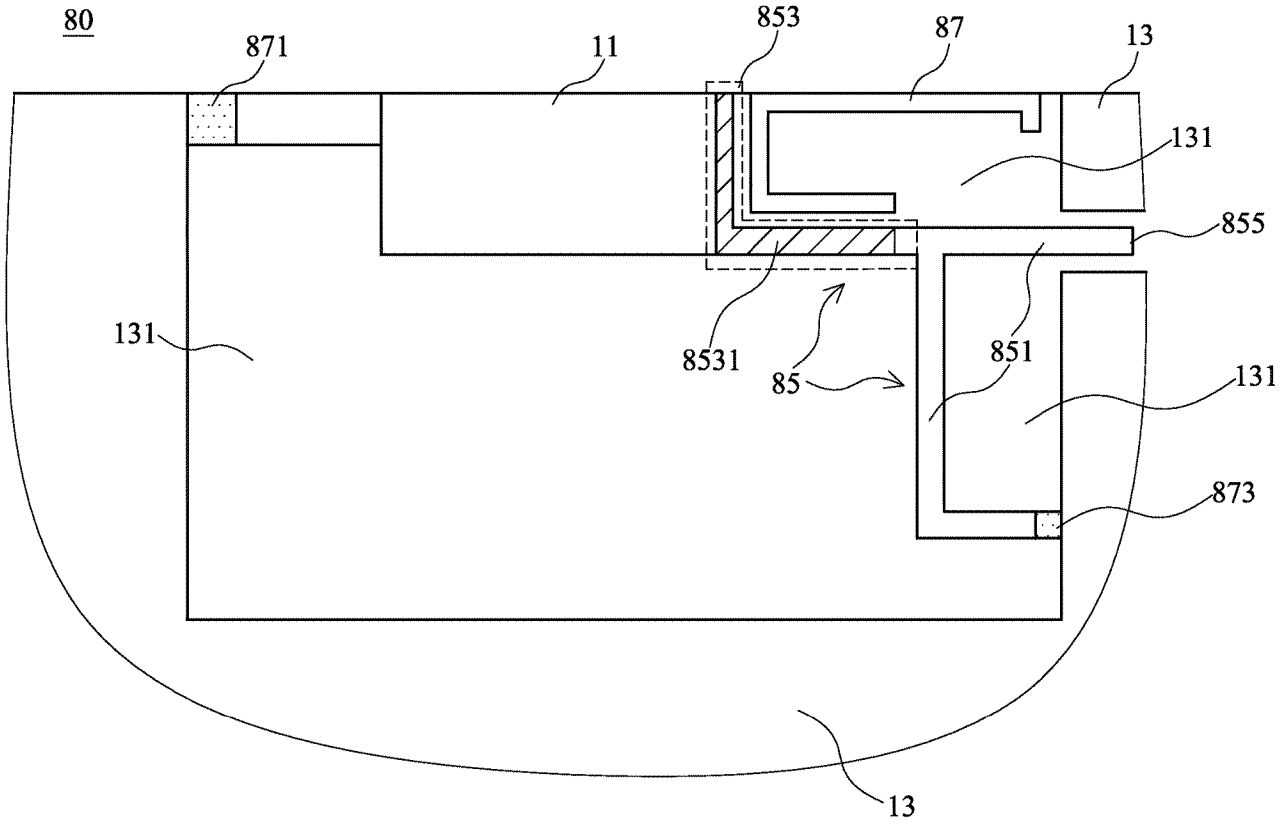
FIG. 15 is a schematic top view of a multi-frequency antenna in accordance with another embodiment of the present invention.

Referring to FIG. 15, there is shown a schematic top view of another embodiment of the multi-frequency antenna in accordance with the present invention. As illustrated, the multi-frequency antenna 80 mainly comprises an antenna unit 11, a ground layer 13, an antenna network 85 and a conductive unit 87, wherein the ground layer 13 comprises a clearance zone 131. The antenna unit 11 and the conductive unit 87 are disposed in the clearance zone 131. Further, a first adjustment device 871 is set between the antenna unit 11 and the ground layer 13. The antenna unit 11 is electrically connected to the ground layer 13 via the first adjustment device 871. Further, a spacing exists between the conductive unit 87 and the ground layer 13.

In this embodiment, referring also to FIG. 2 and FIG. 3, the antenna 11 is adapted for generating at least one first resonance frequency, and comprises a dielectric substrate 12 and a plurality of conducting layers 14, wherein the conducting layers 14 are located on the surface of the dielectric substrate 12.

The antenna network 85 is disposed in the clearance zone 131 and comprises at least one feeding circuit 851 and at least one resonance unit 853. The feeding circuit 851 is electrically connected to a signal feed-in point 855. Further, a second adjustment device 873 is set between the feeding circuit 851 and the ground layer 13. The feeding circuit 851 is electrically connected to the ground layer 13 via the second adjustment device 873. The resonance unit 853 is electrically connected to the antenna unit 11 and the feeding circuit 851 so that the antenna unit 11 is electrically connected to the signal feed-in point 855 via the resonance unit 853 and the feeding circuit 851, and electrically connected to the ground layer 13 via the resonance unit 853, the feeding circuit 851 and the second adjustment device 873. The resonance unit 853 comprises at least one resonant segment 8531 that is disposed adjacent to a part of the conductive unit 87. In this embodiment, a spacing exists between the conductive unit 87 and the ground layer 13. Further, the resonant segment 8531 and the conductive unit 87 are electromagnetically coupled together to generate at least one second resonance frequency.

In this embodiment, the resonant segment 8531 has an L-shaped configuration, and the conductive unit 87 has a substantially C-shaped configuration. In this embodiment, the spacing between at least one resonant segment 8531 and the conductive unit 87 is preferably within the range of 0.01 mm-3 mm. In actual application, the second resonance frequency is adjustable by changing the length, width, area and/or shape of the resonant segment 8531 and/or the conductive unit 87, and/or the spacing between at least one resonant segment 8531 and the conductive unit 87.

In this embodiment, the first adjustment device 871 and the second adjustment device 873 are adapted for fine-tuning the impedance and resonance frequency of the multi-frequency antenna 80. The first adjustment device 871 and the second adjustment device 873 can be, for example, capacitor and/or inductor or resistor. Through the use of capacitors of different capacitance values and/or inductors of different inductance values and/or resistors of different resistance values, the impedance and resonance frequency of the multi-frequency antenna 80 are relatively changed.

Figure 16:
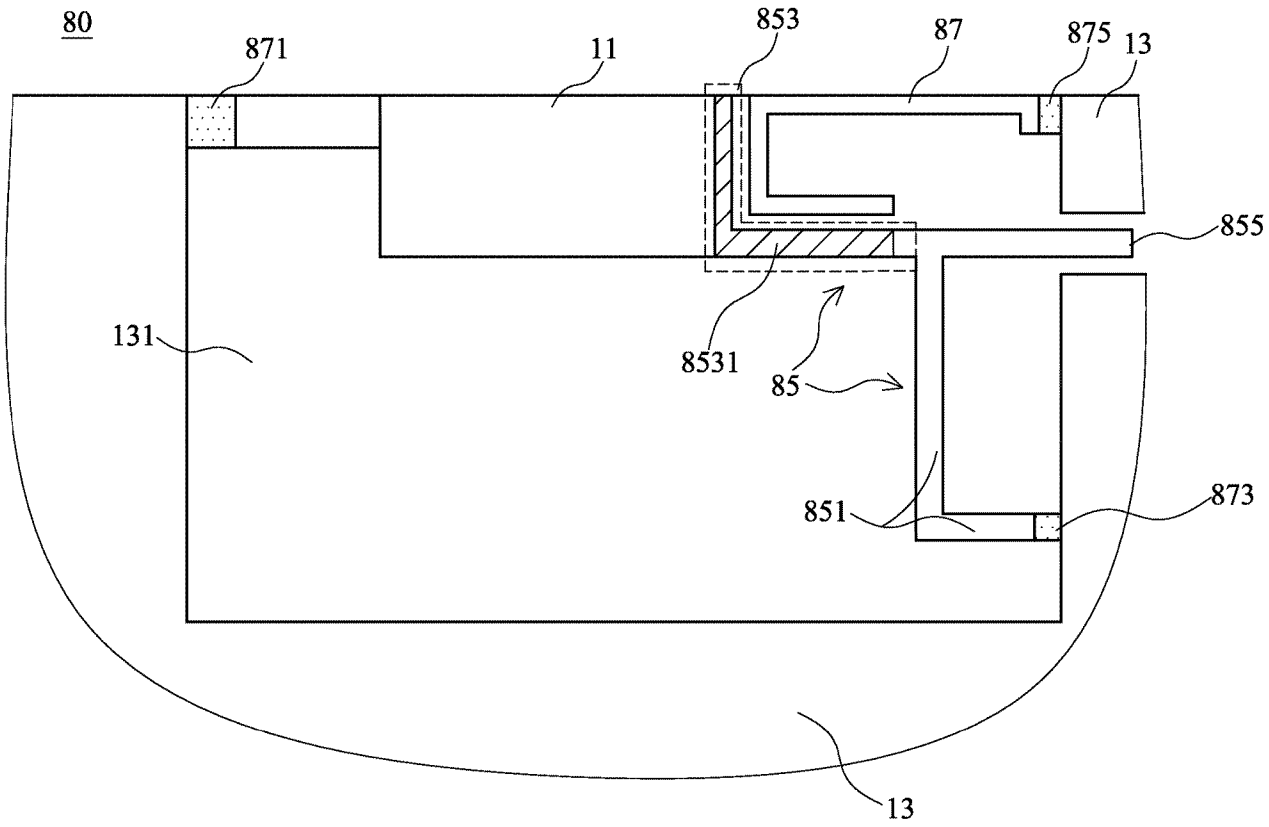
FIG. 16 is a schematic top view of a multi-frequency antenna in accordance with another embodiment of the present invention.

Referring to FIG. 16, there is shown a schematic top view of another embodiment of the multi-frequency antenna in accordance with the present invention. As illustrated, this embodiment is substantially similar to the embodiment shown in FIG. 15 with the exception that this embodiment further comprises a third adjustment device 875 set between the conductive unit 87 and the ground layer 13. Thus, the conductive unit 87 is electrically connected to the ground layer 13 via the third adjustment device 875. The third adjustment device 875 can be formed of capacitor and/or inductor and/or resistor. Through the use of capacitor of different capacitance value and/or inductor of different inductance value and/or resistor of different resistance value, the impedance and resonance frequency of the multi-frequency antenna 80 are relatively changed.

Figure 17:
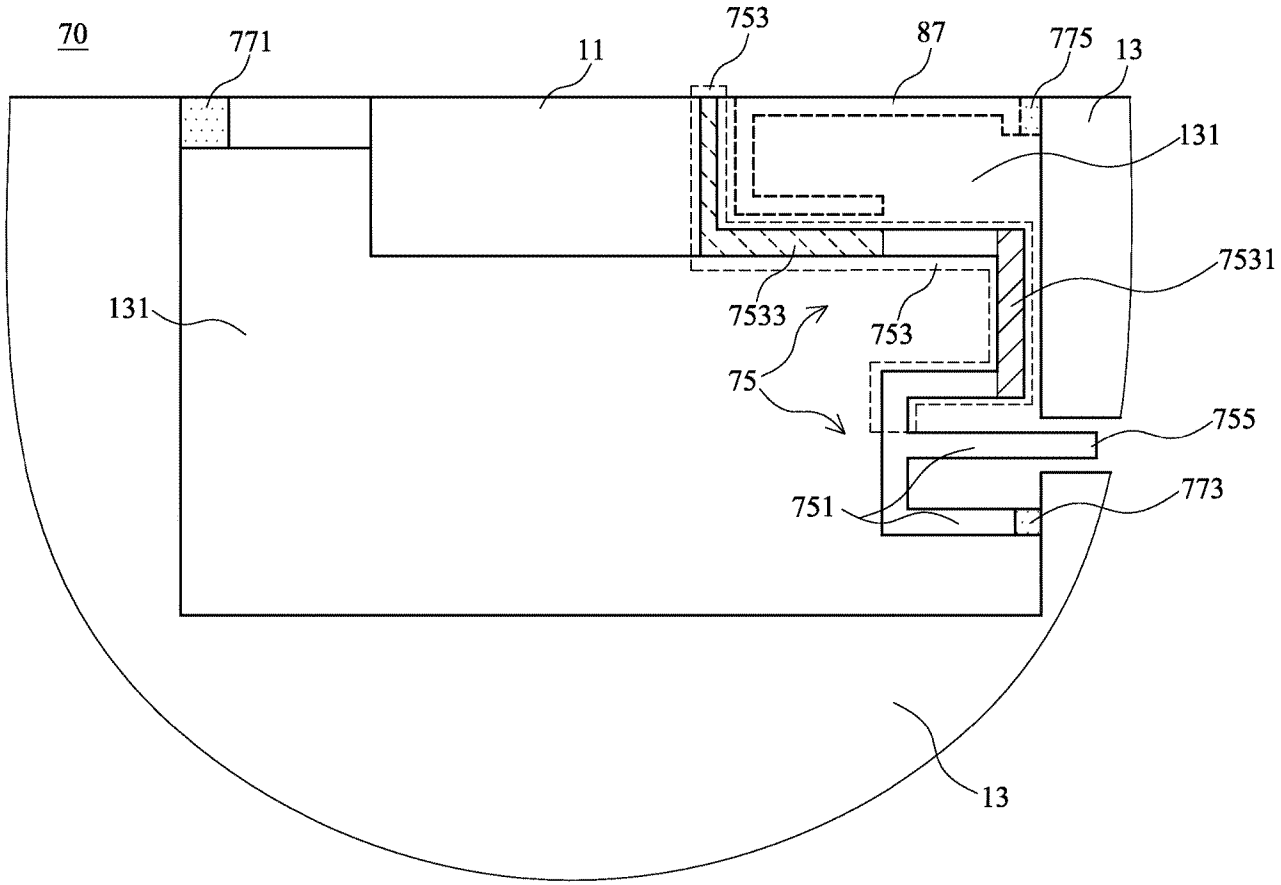
FIG. 17 is a schematic top view of a multi-frequency antenna in accordance with another embodiment of the present invention.

Referring to FIG. 17, there is shown a schematic top view of another embodiment of the multi-frequency antenna in accordance with the present invention. As illustrated, this embodiment is substantially similar to the embodiment shown in FIG. 14 with the exception that this embodiment further comprises a plurality of adjustment units 771/773/775. The first adjustment device 771 is set between the antenna unit 11 and the ground layer 13, and the antenna unit 11 has one end thereof electrically connected to the ground layer 13 via the first adjustment device 771. The second adjustment device 773 is set between the feeding circuit 751 and the ground layer 13, and the antenna unit 11 has an opposite end thereof electrically connected to the ground layer 13 via the antenna network 75 and the second adjustment device 773. The third adjustment device 775 is set between the conductive unit 87 and the ground layer 13, and the conductive unit 87 is electrically connected to the ground layer 13 via the third adjustment device 775. The first adjustment device 771, the second adjustment device 773 and the third adjustment device 775 are adapted for fine-tuning the impedance and resonance frequency of the multi-frequency antenna 70. The first adjustment device 771, the second adjustment device 773 and the third adjustment device 775 can be formed of, for example, capacitors and/or inductors and/or resistors. Through the use of capacitors of different capacitance values and/or inductors of different inductance values and/or resistors of different resistance values, the impedance and resonance frequencies of the multi-frequency antenna 70 are relatively changed.

It is to be understood that the invention is not limited to particular systems described which may, of course, vary. It is also to be understood that the terminology used herein is for the purpose of describing particular embodiments only, and is not intended to be limiting. As used in the present invention, the singular forms "a", "an" and "the" include plural referents unless the content clearly indicates otherwise. Thus, for example, reference to "a device" includes a combination of two or more devices and reference to "a material" includes mixtures of materials.

Further modifications and alternative embodiments of various aspects of the present invention will be apparent to those skilled in the art in view of this description. Accordingly, this description is to be construed as illustrative only and is for the purpose of teaching those skilled in the art the general manner of carrying out the invention. It is to be understood that the forms of the invention shown and described herein are to be taken as the presently preferred embodiments. Elements and materials may be substituted for those illustrated and described herein, parts and processes may be reversed, and certain features of the invention may be utilized independently, all as would be apparent to one skilled in the art after having the benefit of this description of the invention. Changes may be made in the elements described herein without departing from the spirit and scope of the invention as described in the following claims.

What is claimed is:

1. A multi-frequency antenna comprising:

a ground layer comprising at least one clearance zone;

at least one antenna unit disposed in said clearance zone and electrically connected to said ground layer for generating at least one first resonance frequency, each said antenna unit comprising a dielectric substrate having a first surface and a second surface, and a plurality of conducting layers located on the surfaces of said dielectric substrate, said conducting layers comprising at least one first conducting layer and at least one second conducting layer;

an antenna network disposed in said clearance zone, comprising at least one feeding circuit connected to a signal feed-in point and said ground layer, at least one resonance unit connected to said antenna unit and said feeding circuit, each said resonance unit comprising at least one resonant segment, each said resonant segment being disposed adjacent to a part of said ground layer and electromagnetically coupled with said part of ground layer to generate and adjust at least one second resonance frequency, wherein said second resonance frequency is different from said first resonance frequency;

wherein said resonant segment of said resonance unit comprises a first resonant segment and a second resonant segment respectively disposed adjacent to said part of ground layer and respectively electromagnetically coupled with said part of ground layer to generate respectively one said second resonance frequency.

2. The multi-frequency antenna as claimed in claim 1, wherein said first conducting layer of said antenna unit is located on said first surface of said dielectric substrate and electrically connected to said ground layer; said second conducting layer of said antenna unit is located on said second surface of said dielectric substrate and connected to said resonance unit of said antenna network, and a part of said first conducting layer overlaps a part of said second conducting layer.

3. The multi-frequency antenna as claimed in claim 1, wherein said first conducting layer and said second conducting layer are located on said first surface of said dielectric substrate, said first conducting layer and said second conducting layer being connected to said resonance unit and said ground layer respectively, wherein said first conducting layer and said second conducting layer are spaced from each other by a gap.

4. The multi-frequency antenna as claimed in claim 1, wherein the spacing between said first resonant segment and said ground layer is in the range of 0.01 mm-3 mm; the spacing between said second resonant segment and said ground layer is in the range of 0.01 mm-3 mm.

5. The multi-frequency antenna as claimed in claim 1, wherein said ground layer comprises at least one extension unit disposed adjacent to said resonant segment of said resonance unit and spaced therefrom by a spacing in the range of 0.01 mm-3 mm.

6. A multi-frequency antenna comprising:

a ground layer comprising at least one clearance zone;

at least one antenna unit disposed in said clearance zone and electrically connected to said ground layer for generating at least one first resonance frequency, each said antenna unit comprising a dielectric substrate having a first surface and a second surface, and a plurality of conducting layers located on the surfaces of said dielectric substrate, said conducting layers comprising at least two first conducting layers and at least one second conducting layer;

an antenna network disposed in said clearance zone, comprising at least one feeding circuit connected to a signal feed-in point and said ground layer, at least one resonance unit connected to said antenna unit and said feeding circuit, each said resonance unit comprising at least one resonant segment, each said resonant segment being disposed adjacent to a part of said ground layer and electromagnetically coupled with said part of ground layer to generate and adjust at least one second resonance frequency, wherein said second resonance frequency is different from said first resonance frequency, wherein said two first conducting layers are separately disposed on said first surface of said dielectric substrate, one of said first conducting layers being connected to said resonance unit, the other said first conducting layer being connected to another signal feed-in point and said ground layer; at least one second conducting layer is disposed on said second surface of said dielectric substrate and is electrically connected to said ground layer, a part of each said two first conducting layers overlap respectively a part of said second conducting layer.

7. A multi-frequency antenna comprising:

a ground layer comprising at least one clearance zone;

at least one antenna unit disposed in said clearance zone and electrically connected to said ground layer for generating at least one first resonance frequency, each said antenna unit comprising a dielectric substrate having a first surface and a second surface, a plurality of conducting layers located on the surfaces of said dielectric substrate and comprising at least one first conducting layer and at least one second conducting layer;

a first adjustment device set between said ground layer and said antenna unit and electrically connected to said ground layer and said antenna unit for fine-tuning said first resonance frequency;

an antenna network disposed in said clearance zone, comprising at least one feeding circuit connected to a signal feed-in point and said ground layer, at least one resonance unit connected to said antenna unit and said feeding circuit, each said resonance unit comprising at least one resonant segment disposed adjacent to a part of said ground layer and electromagnetically coupled with said part of ground layer for generating and adjusting at least one second resonance frequency, wherein said second resonance frequency is different from said first resonance frequency, wherein the spacing between said resonant segment and said ground layer is in the range of 0.01 mm-3 mm; and a second adjustment device set between said feeding circuit and said ground layer and electrically connected to said feeding circuit and said ground layer for fine-tuning said second resonance frequency.

8. The multi-frequency antenna as claimed in claim 7, wherein said first conducting layer of said antenna unit is located on said first surface of said dielectric substrate and electrically connected to said ground layer via said first adjustment device; said second conducting layer is located on said second surface of said dielectric substrate and connected to said ground layer via said resonance unit, said feeding circuit and said second adjustment device, a part of said first conducting layer overlaps a part of said second conducting layer.

9. The multi-frequency antenna as claimed in claim 7, wherein said first conducting layer and said second conducting layer are located on said first surface of said dielectric substrate; said first conducting layer being electrically connected to said ground layer via said first adjustment device, said second conducting layer being connected to said ground layer via said resonance unit, said feeding circuit and said second adjustment device, said first conducting layer being spaced from said second conducting layer by a gap.

10. The multi-frequency antenna as claimed in claim 7, further comprising at least one conductive unit disposed in said clearance zone and being adjacent to and electromagnetically coupled with said resonant segment of said resonance unit.

11. The multi-frequency antenna as claimed in claim 10, further comprising a third adjustment device electrically connected to said conductive unit and said ground layer for fine-tuning said second resonance frequency.

12. A multi-frequency antenna comprising:

a ground layer comprising at least one clearance zone;

at least one antenna unit disposed in said clearance zone and electrically connected to said ground layer for generating at least one first resonance frequency, each said antenna unit comprising a dielectric substrate having a first surface and a second surface, a plurality of conducting layers located on the surfaces of said dielectric substrate and comprising at least one first conducting layer and at least one second conducting layer;

a first adjustment device set between said ground layer and said antenna unit and electrically connected to said ground layer and said antenna unit for fine-tuning said first resonance frequency;

at least one conductive unit disposed in said clearance zone;

an antenna network disposed in said clearance zone, comprising at least one feeding circuit connected to a signal feed-in point and said ground layer, at least one resonance unit connected to said antenna unit and said feeding circuit, each said resonance unit comprising at least one resonant segment disposed adjacent to said conductive unit and electromagnetically coupled with said conductive unit for generating and adjusting at least one second resonance frequency, wherein said second resonance frequency is different from said first resonance frequency, wherein the spacing between said resonant segment and said conductive unit is within the range of 0.01 mm-3 mm;

a second adjustment device set between said feeding circuit and said ground layer and electrically connected to said feeding circuit and said ground layer for fine-tuning said second resonance frequency.

13. The multi-frequency antenna as claimed in claim 12, further comprising a third adjustment device electrically connected to said conductive unit and said ground layer for fine-tuning said second resonance frequency.

14. The multi-frequency antenna as claimed in claim 13, wherein said first adjustment device, said second adjustment device and said third adjustment device each comprise at least one capacitor, at least one inductor or at least one resistor.

* * * * *